US009472154B2

(12) United States Patent
Hwang et al.

(10) Patent No.: US 9,472,154 B2
(45) Date of Patent: Oct. 18, 2016

(54) DISPLAY PANEL AND DISPLAY APPARATUS HAVING THE SAME

(71) Applicant: Samsung Display Co., LTD., Yongin, Gyeonggi-Do (KR)

(72) Inventors: In-Jae Hwang, Suwon-si (KR); Il-Gon Kim, Seoul (KR); Mee-Hye Jung, Suwon-si (KR); Se-Hyoung Cho, Hwaseong-si (KR); Jang-Mi Kang, Bucheon-si (KR); Hee-Rim Song, Seoul (KR); Bong-Hyun You, Yongin-si (KR)

(73) Assignee: Samsung Display Co., Ltd. (KR)

( * ) Notice: Subject to any disclaimer, the term of this patent is extended or adjusted under 35 U.S.C. 154(b) by 84 days.

(21) Appl. No.: 14/310,593

(22) Filed: Jun. 20, 2014

(65) Prior Publication Data

US 2015/0009109 A1 Jan. 8, 2015

(30) Foreign Application Priority Data

Jul. 5, 2013 (KR) ..... 10-2013-0078969

(51) Int. Cl.
*G09G 3/36* (2006.01)

(52) U.S. Cl.
CPC ..... *G09G 3/3677* (2013.01); *G09G 3/3614* (2013.01); *G09G 2300/0426* (2013.01); *G09G 2310/08* (2013.01); *G09G 2320/0209* (2013.01); *G09G 2320/0223* (2013.01)

(58) Field of Classification Search
None
See application file for complete search history.

(56) References Cited

U.S. PATENT DOCUMENTS

| | | | | |
|---|---|---|---|---|
| 2009/0040161 | A1 | 2/2009 | Baek et al. | |
| 2009/0079669 | A1 | 3/2009 | Huang et al. | |
| 2012/0026206 | A1* | 2/2012 | Moon | G09G 3/3614 345/690 |
| 2012/0293762 | A1* | 11/2012 | Shin | G09G 3/3677 349/139 |
| 2014/0204065 | A1* | 7/2014 | Park | G09G 5/18 345/204 |

FOREIGN PATENT DOCUMENTS

| | | | |
|---|---|---|---|
| KR | 1020070034381 | A | 3/2007 |
| KR | 1020070071325 | A | 7/2007 |
| KR | 1020070109296 | A | 11/2007 |
| KR | 1020070110624 | A | 11/2007 |
| KR | 1020080105827 | A | 12/2008 |
| KR | 1020090006997 | A | 1/2009 |
| KR | 1020090011156 | A | 2/2009 |
| KR | 1020090126764 | A | 12/2009 |
| KR | 1020100128019 | A | 12/2010 |
| KR | 1020110101892 | A | 9/2011 |

* cited by examiner

*Primary Examiner* — Kenneth B Lee, Jr.
(74) *Attorney, Agent, or Firm* — Innovation Counsel LLP

(57) ABSTRACT

A display panel includes a plurality of pixels which is arranged in a pixel column and a pixel row, a gate line which is connected to pixels in a same pixel row, a first data line which is connected to pixels in a same pixel column, and a second data line which is connected to remaining pixels except for the pixels connected to the first data line among the pixels in the same pixel column. Two odd-numbered pixel rows and two even-numbered pixel rows are alternately driven so that a charge period of the pixel may be extended by 2H. In addition, a kickback difference between the odd-numbered pixel row and the even-numbered pixel row may be decreased so that a display quality may be improved.

19 Claims, 6 Drawing Sheets

DISPLAY PANEL AND DISPLAY APPARATUS HAVING THE SAME

This application claims priority from and the benefit of Korean Patent Application No. 10-2013-0078969 filed on Jul. 5, 2013, which is hereby incorporated by reference for all purposes as if fully set forth herein.

BACKGROUND

1. Field of Disclosure

The present disclosure of invention relates to a display panel and a display apparatus having the display panel. More particularly, the present disclosure relates to a display panel capable of improving a display quality and a display apparatus having the above-mentioned display panel.

2. Description of Related Technology

Generally, a liquid crystal display LCD apparatus has a relatively small thickness, low weight and low power consumption. Thus the LCD apparatus is used in monitors, laptop computers and cellular phones, etc. The LCD apparatus includes an LCD panel displaying images using a selectively changeable light transmittance characteristic of a liquid crystal while a backlight assembly disposed under the LCD panel provides light to the LCD panel. A driving circuit drives the LCD panel and thereby causes the selective changes of the light transmittance characteristic of the liquid crystals.

The liquid display panel includes an array substrate which has a plurality of gate lines, a plurality of crossing data lines, a plurality of thin film transistors and corresponding pixel electrodes. The liquid display panel also includes an opposing substrate which has a common electrode. A liquid crystal layer is interposed between the array substrate and opposing substrate. The driving circuit includes a gate driving part which drives the gate lines of the array substrate and a data driving part which drives the data lines.

Recently, the liquid display panel has become bigger in terms of display area (DA) so that a resistance-capacitance (RC) time delay factor that can delay gate signals transferred through the gate lines can occur. A similar RC time delay factor can similarly delay the data signals that are transferred through respective one of the data lines. More specifically, the RC time delay can have its greatest effect on in portions of the display area (DA) farthest away from the gate driving part that is outputting the gate signals. The gate signals control a charging period during which respective data signals are charged into the pixels of a given row. When the gate signal switches to the off state, charging stops. As a result, a charging ratio may be disadvantageously decreased by increased RC time delays experienced by some of the gate signals. Therefore, a low quality display, such as lowering of luminance, color mixing, ghost, etc, may occur due to the effects of increased RC time delay.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

SUMMARY

A method of operating a display apparatus in accordance with the present disclosure is provided where the display apparatus comprises a plurality of pixels arranged as pixel columns and pixel rows; and the display apparatus further comprises a plurality of gate lines each connected to pixels of a respective one of the pixel rows; wherein each pixel column includes a first data line connected to a first subset of the pixels in that pixel column; and wherein each pixel column further includes a second data line connected to a mutually exclusive second subset of the pixels in that same pixel column. The method comprises simultaneously driving both the first and second data lines of at least one of the pixel columns; and simultaneously driving both of first and second of the gate lines with row activating signals such that at least two pixels within the at least one pixel column are simultaneously charged. The charging time of each pixel may then be extended to as much as 2-horizontal (2H) scan periods of the display apparatus.

According to an exemplary embodiment of the invention, there is provided a display panel includes a plurality of pixels which is arranged in a pixel column and a pixel row, a gate line which is connected to pixels in a same pixel row, a first data line which is connected to pixels in a same pixel column, and a second data line which is connected to remaining pixels except for the pixels connected to the first data line among the pixels in the same pixel column.

In an exemplary embodiment, the pixels in the same pixel column may be alternately connected to the first and second data lines by two pixels.

In an exemplary embodiment, the display panel may further include a third data line which is connected to pixels of a second pixel column adjacent to a first pixel column and a fourth data line which is connected to remaining pixels except for the pixels connected to the third data line among the pixels in the second pixel column, wherein the first and second data lines may be connected to the pixels of the first pixel column.

In an exemplary embodiment, (4N−3)-th and (4N−2)-th pixels in the first pixel column may be connected to the first data line, (4N−1)-th and 4N-th pixels in the first pixel column may be connected to the second data line adjacent to the first data line, (4N−1)-th and 4N-th pixels in the second pixel column may be connected to the third data line adjacent to the second data line, and (4N−3)-th and (4N−2)-th pixels in the second pixel column may be connected to the fourth data line adjacent to the third data line.

According to an exemplary embodiment of the invention, there is provided a display apparatus includes a display panel which comprises a plurality of pixels which is arranged in a pixel column and a pixel row, a gate line which is connected to pixels in a same pixel row, a first data line and a second data line which are connected to pixels in a same pixel column, a gate driving part which concurrently outputs two gate signals and a data driving part which concurrently outputs data signals corresponding to two pixel rows.

In an exemplary embodiment, the pixels in the same pixel column may be alternately connected to the first and second data lines by two pixels.

In an exemplary embodiment, the gate driving part may alternately output two odd-numbered gate signals and two even-numbered gate signals.

In an exemplary embodiment, a falling period of an odd-numbered gate signal may be spaced apart from a rising period of an even-numbered gate signal, wherein the falling period of a gate signal being a period during which a level of the gate signal falls from a high level to a low level and the rising period of the gate signal being a period during which a level of the gate signal rises from a low level to a high level.

In an exemplary embodiment, the odd-numbered and even-numbered gate signal may respectively have a high pulse corresponding to two horizontal periods.

In an exemplary embodiment, the data driving part may output a data signal of a first polarity with respect to a reference signal to the first data line and a data signal of a second polarity with respect to the reference signal to the second data line.

In an exemplary embodiment, the display panel may further include a third data line which is connected to pixels of a second pixel column adjacent to a first pixel column and a fourth data line which is connected to remaining pixels except for the pixels connected to the third data line among the pixels in the second pixel column, wherein the first and second data lines are connected to the pixels of the first pixel column.

In an exemplary embodiment, (4N−3)-th and (4N−2)-th pixels of the first pixel column may be connected to the first data line, (4N−1)-th and 4N-th pixels of the first pixel column may be connected to the second data line adjacent to the first data line, (4N−1)-th and 4N-th pixels of the second pixel column may be connected to the third data line adjacent to the second data line, and (4N−3)-th and (4N−2)-th pixels of the second pixel column may be connected to the fourth data line adjacent to the third data line.

In an exemplary embodiment, the data driving part may output a data signal of the first polarity to the third data line and a data signal of the second polarity to the fourth data line.

In an exemplary embodiment, the gate driving part may include a plurality of shift registers, where first, second, third and fourth shift registers of the plurality of shift registers receive a vertical start signal, the gate driving part being activated by the vertical start signal.

In an exemplary embodiment, the gate driving part may be formed as a chip and mounted on the display panel.

In an exemplary embodiment, the gate driving part may control a rising period of a high pulse in a (4N−3)-th gate signal base on a first clock signal, a rising period of a high pulse in a (4N−2)-th gate signal base on a second clock signal, a rising period of a high pulse in a (4N−1)-th gate signal base on a third clock signal and a rising period of a high pulse in a 4N-th gate signal base on a fourth clock signal.

In an exemplary embodiment, the first clock signal may be the same as the third clock signal and the second clock may be the same as the fourth clock signal.

In an exemplary embodiment, the gate driving part may include a plurality of switching elements be formed on the display panel via a fabrication process substantially the same as that used for forming a pixel switching element included in the pixel.

In an exemplary embodiment, the gate driving part may control a rising period of a high pulse in a (4N−3)-th gate signal base on a first clock signal, a rising period of a high pulse in a (4N−2)-th gate signal base on a first inversion clock signal opposite to the first clock signal, a rising period of a high pulse in a (4N−1)-th gate signal base on a second clock signal and a rising period of a high pulse in a 4N-th gate signal base on a second inversion clock signal opposite to the second clock signal.

In an exemplary embodiment, the first clock signal may be the same as the second clock signal.

According to the present disclosure of invention, two odd-numbered pixel rows and two even-numbered pixel rows are alternately driven as pairs so that a charge period of the pixels may be extended to as much as 2H scan periods. In addition, a kickback difference between the odd-numbered pixel row and the even-numbered pixel row may be decreased so that a display quality may be improved. In addition, the display panel may be driven with a column inversion mode so that power consumption may be reduced.

BRIEF DESCRIPTION OF THE DRAWINGS

The above and other features and advantages of the present disclosure of invention will become more apparent by describing in detailed exemplary embodiments thereof with reference to the accompanying drawings, in which.

DETAILED DESCRIPTION

Hereinafter, the present teachings will be explained in detail with reference to the accompanying drawings.

Figure 1:
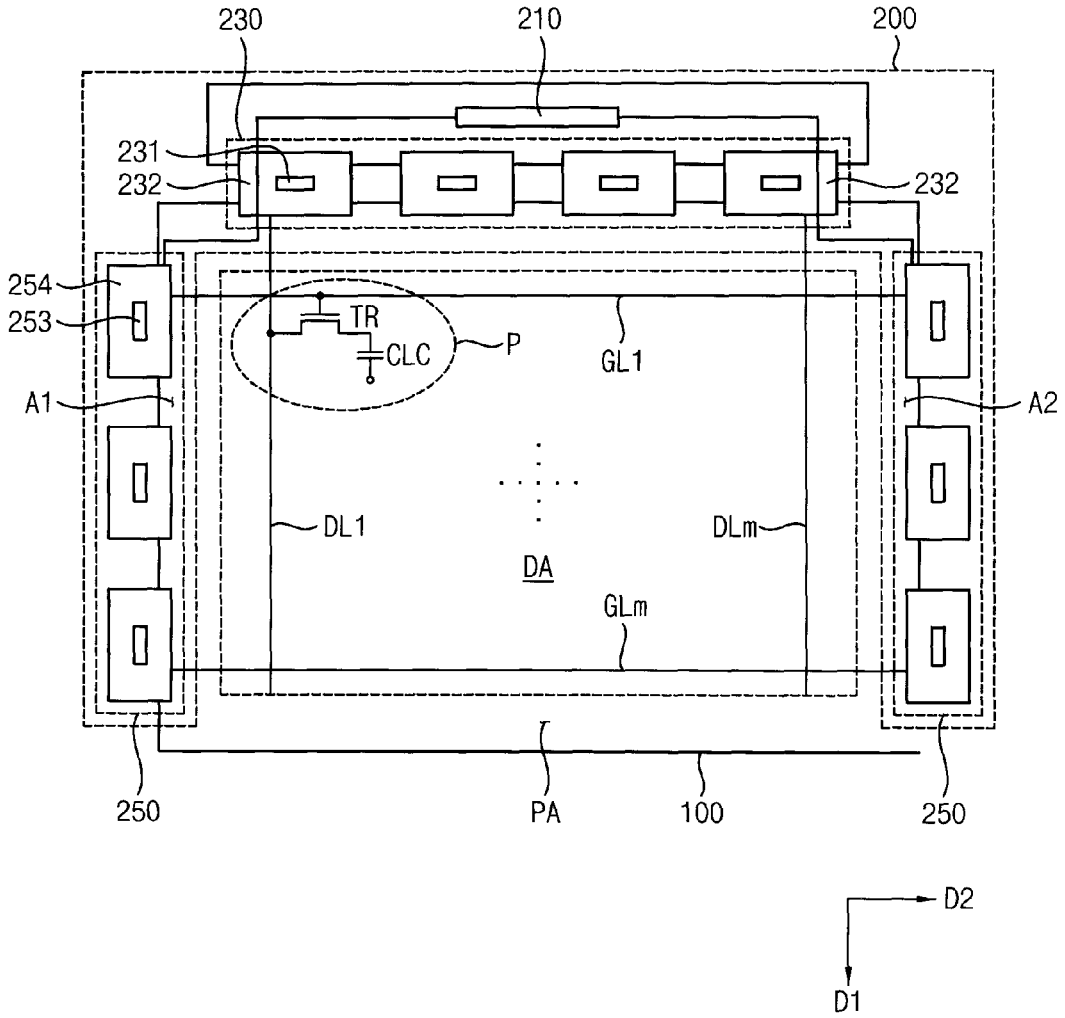
FIG. 1 is a plan view illustrating a display apparatus according to an exemplary embodiment.
Figure 2:
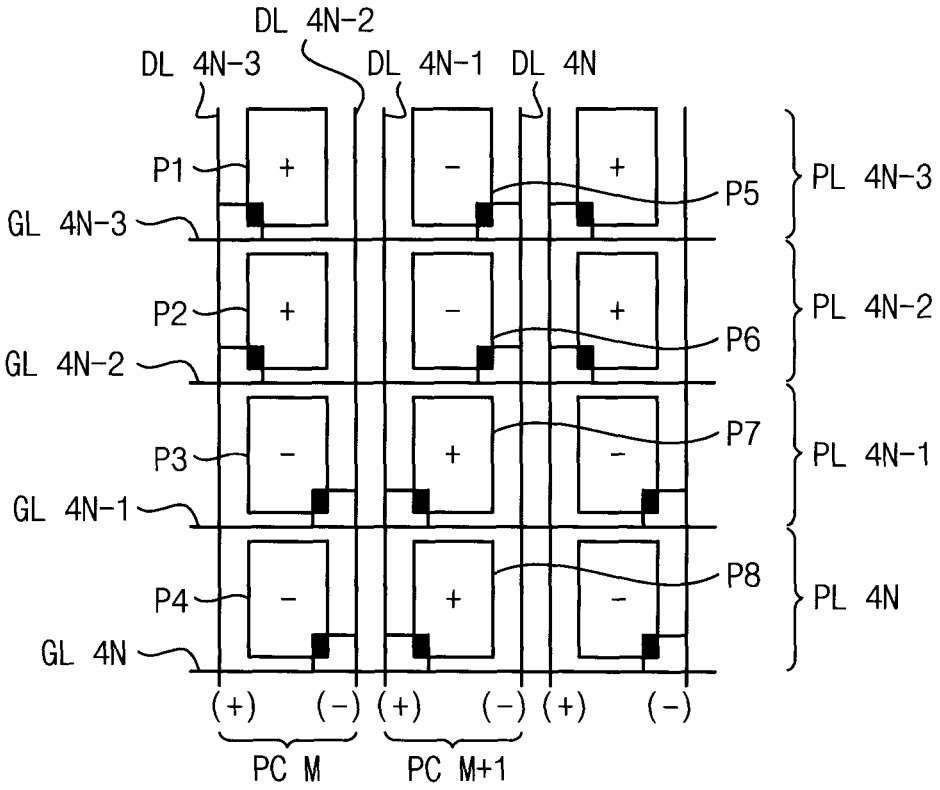
FIG. 2 is a conceptual diagram illustrating a pixel of the display apparatus as shown in FIG. 1.

FIG. 1 is a plan view illustrating a display apparatus according to an exemplary embodiment. FIG. 2 is a conceptual diagram illustrating a plurality of pixels among those of the display apparatus as shown in FIG. 1.

Referring to FIGS. 1 and 2, the display apparatus may include a display panel 100 configured for displaying an image and a display driving part 200 configured for driving the display panel 100.

The display panel 100 includes a display area DA and a non-displaying peripheral area PA surrounding the display area DA. A plurality of pixels P, a plurality of data lines DL1, . . . , DLm and a plurality of gate lines GL1, . . . , GLn are disposed in the display area DA (herein, m and n are a natural number). The display driving part 200 is disposed in the peripheral area PA.

The pixels P are arranged as a matrix which includes pixel columns each having pixels arranged in a first direction D1 (Y axis) and pixel rows each having pixels arranged in a second direction D2 (X axis) crossing the first direction D1.

The data lines DL1, . . . , DLm longitudinally extend in the first direction D1 and are arranged as spaced apart from each other along the second direction D2. The data lines DL1, . . . , DLm are electrically connected to the pixels P in the respective pixel columns and transfer respective data signals to their respective pixels P of that column. In the exemplary embodiments, each pixel column is serviced by two data lines. In other words, a pair of data lines DL4N−3 and DL4N−2 are electrically connected to respective, first polarity-driven or second polarity-driven pixels P in a same pixel column. For example, a (4N−3)-th data line DL4N−3 is connected to the pixels in a corresponding pixel column PCm which in one example will be driven with positive polarity (+) data signals and at the same time a (4N−2)-th data line DL4N−2 is connected to remaining pixels in the same pixel column PCm which will be driven with positive negative (−) data signals, in other words, all the other pixels except for the pixels connected to the (4N−3)-th data line DL4N−3.

The gate lines GL1, . . . , GLn longitudinally extend in the second direction D2 and are arranged as spaced apart along the first direction D1. Each of the gate lines GL1, . . . , GLn is electrically connected to the pixels P in a same pixel row and transfer a gate signal to the pixels P.

Each pixel P includes a pixel switching element TR and a liquid crystal capacitor CLC. The pixel switching element TR which includes a gate electrode connected to a respective gate line (e.g., GL1), a source electrode connected to a respective data line (e.g., DL1) and a drain electrode connected to the corresponding liquid crystal capacitor CLC.

The display driving part 200 may include a control circuit part 210, a data driving part 230 and a gate driving part 250.

The control circuit part 210 controls an operation of the data driving part 230 and the gate driving part 250. For example, the control circuit part 210 provides the data driving part 230 with a data signal and a data control signal. The data signal may include a color data signal and may be a signal corrected using one or more compensation algorithms to improve a response time of liquid crystal and to compensate for a white. The data control signal may include a horizontal synchronization signal, a vertical synchronization signal, a load signal, etc. The control circuit part 210 provides the gate driving part 250 with a gate control signal. The gate control signal may include a vertical start signal, a plurality of clock signals, an output enable signal, etc.

The data driving part 230 may include a plurality of data signal producing flexible circuit boards 232 and each of the data signal producing flexible circuit boards 232 may include a data lines driving chip 231 disposed thereon. The data flexible circuit board 232 electrically connects the printed circuit board (PCB) 220 and the display panel 100. one or more data flexible circuit boards 232, such as one or more data flexible circuit boards 232 disposed adjacent to the gate driving part 250 among the plurality of data flexible circuit boards 232 may include a dummy signal line and the gate control signal, the gate-on signal, and the gate-off signal output from the control circuit part 210 may be transferred to the gate driving part 250 through the dummy signal line.

The gate driving part 250 include a plurality of gate signal producing flexible circuit boards 254 and each of the gate signal producing flexible circuit boards 254 may include a gate lines driving chip 253 disposed thereon. The gate driving part 250 may be disposed such as a dual structure. For example, the gate driving part 250 may include a first gate driving part which is connected to first end portions of the gate lines GL1, . . . , GLn and is disposed in a first area A1 of the peripheral area PA and a second gate driving part which is connected to second end portions of the gate lines GL1, . . . , GLn opposite to the first end portions and is disposed in a second area A2 of the peripheral area PA. The first and second gate driving parts provide respective ones of same gate lines with a same gate signal from opposite ends of the gate line. Therefore, a degradation of the gate signal by a RC delay time may be compensated for. Although not shown in figures, the gate driving part 250 may have a single structure which is disposed in the first or second area A1 or A2.

The gate driving part 250 provides the gate lines GL1, . . . , GLn with respective gate signals.

In the exemplary embodiments, the gate driving part 250 alternately outputs two odd-numbered gate signals in a first time period (so as to drive at the same time a positive polarity (+) driven pixel in a given column (e.g., PCm) and also a negative polarity (+) driven pixel in the same given column (e.g., PCm)) and two even-numbered gate signals in a next successive time period (so as to drive at the same time another positive polarity (+) driven pixel in a given column (e.g., PCm) and also another negative polarity (+) driven pixel in the same given column (e.g., PCm)). The two odd-numbered gate signals are a same row-activating signal and the two even-numbered gate signals are a same row-activating signal. The gate driving part 250 provides the two odd-numbered gate lines with the row-activating two odd-numbered gate signals and then provides a successive two even-numbered gate lines with the row-activating two even-numbered gate signals.

For example, a pixel structure of the display panel 100 according to the exemplary embodiments may be the same as shown in FIG. 2.

The display panel 100 may include a plurality of pixel columns and a plurality of pixel rows.

The pixels in an M-th pixel column PCM are connected to a pair data lines comprised of a (4N−3)-th data line DL4N−3 and a (4N−2)-th data line DL4N−2 (herein, N is a natural number such as 1, 2, 3, . . . ). The (4N−3)-th data line DL4N−3 is connected to odd and even numbered pixels such as the (4N−3)-th and (4N−2)-th pixels P1 and P2 which are connected to (4N−3)-th and (4N−2)-th gate lines GL4N−3 and GL4N−2 among the pixels in the M-th pixel column PCM. The (4N−2)-th data line DL4N−2 is connected to others of the odd and even numbered pixels such as the (4N−1)-th and 4N-th pixels P3 and P4 which are connected to (4N−1)-th and 4N-th gate lines GL4N−1 and GL4N among the pixels in the M-th pixel column PCM.

The (4N−3)-th data line DL4N−3 may receive the data signal of a positive polarity (+) with respect to a reference voltage and the (4N−2)-th data line DL4N−2 may at the same time receive the data signal of a negative polarity (−) with respect to the reference voltage.

The pixels in an (M+1)-th pixel column PCM+1 are connected to a pair of a (4N−1)-th data line DL4N−1 and a 4N-th data line DL4N. The (4N−1)-th data line DL4N−1 is connected to (4N−1)-th and 4N-th pixels P7 and P8 which are connected to (4N−1)-th and 4N-th gate lines GL4N−1 and GL4N among the pixel in the (M+1)-th pixel column PCM+1. The 4N-th data line DL4N 1 is connected to (4N−3)-th and (4N−2)-th pixels P5 and P6 which are connected to (4N−3)-th and (4N−2)-th gate lines GL4N−3 and GL4N−2 among the pixels in the (M+1)-th pixel column PCM+1. The (4N−1)-th data line DL4N−1 may receive the data signal of the positive polarity (+) and the 4N-th data line DL4N may at the same time receive the data signal of the negative polarity (−).

The (4N−3)-th and (4N−1)-th gate lines GL4N−3 and GL4N−1 are the two odd-numbered gate lines that in accordance with one embodiment, are the ones that concurrently receive the same row-activating gate signal so that in the first odd row (PL4N−3), the corresponding pixels P1(+) and P5(−) are simultaneously activated for a recharging and so that in the second odd row (PL4N−1), the corresponding pixels P3(−) and P7(+) are simultaneously activated for a recharging. Thus, the pixel P1 connected to the (4N−3)-th data line DL4N−3 charges with the data signal of the positive polarity (+) and the pixel P5 connected to the 4N-th data line DL4N charges with the data signal of the negative polarity (−). Similarly, the pixel P3 connected to the (4N−

2)-th data line DL4N−2 charges with the data signal of the negative polarity (−) and the pixel P7connected to the (4N−1)-th data line DL4N−1 charges with the data signal of the positive polarity (+).

Then, in a next scan lines recharging period, the (4N−2)-th and 4N-th gate lines GL4N−2 and GL4N which are the two even-numbered gate lines are concurrently driven to receive the same row activating gate signal so that the pixels P2(+) and P6(−) of the (4N−2)-th pixel row PL4N−2 are simultaneously activated for a recharging and so that the pixels P4(−) and P8(+) of the 4N-th pixel row PL4N are simultaneously activated for a recharging. Thus, the pixel P2 connected to the (4N−3)-th data line DL4N−3 charges with the data signal of the positive polarity (+) and the pixel P5 connected to the 4N-th data line DL4N charges the data signal of the negative polarity (−). Similarly, the pixel P4 connected to the (4N−2)-th data line DL4N−2 charges with the data signal of the negative polarity (−) and the pixel P8 connected to the (4N−1)-th data line DL4N−1 charges with the data signal of the positive polarity (+).

As shown in FIG. 2, in the exemplary embodiments, the display panel 100 may be driven in accordance with a polarity inversion mode in which polarity is inverted every column in the D2 direction (horizontally) and polarity is inverted every two rows in the D1 direction (vertically).

Figure 3:
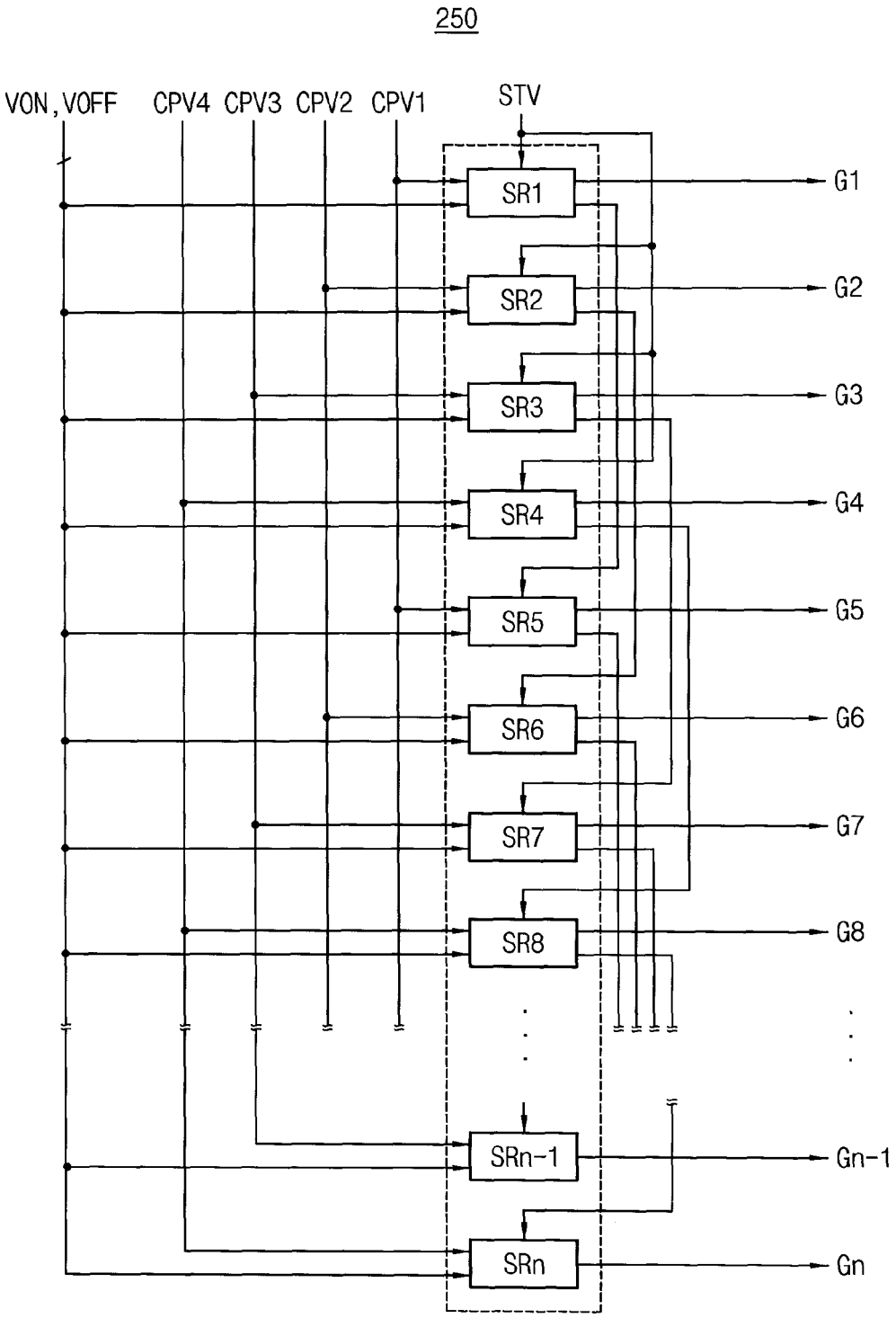
FIG. 3 is a block diagram illustrating a gate driving part as shown in FIG. 1.
Figure 4:
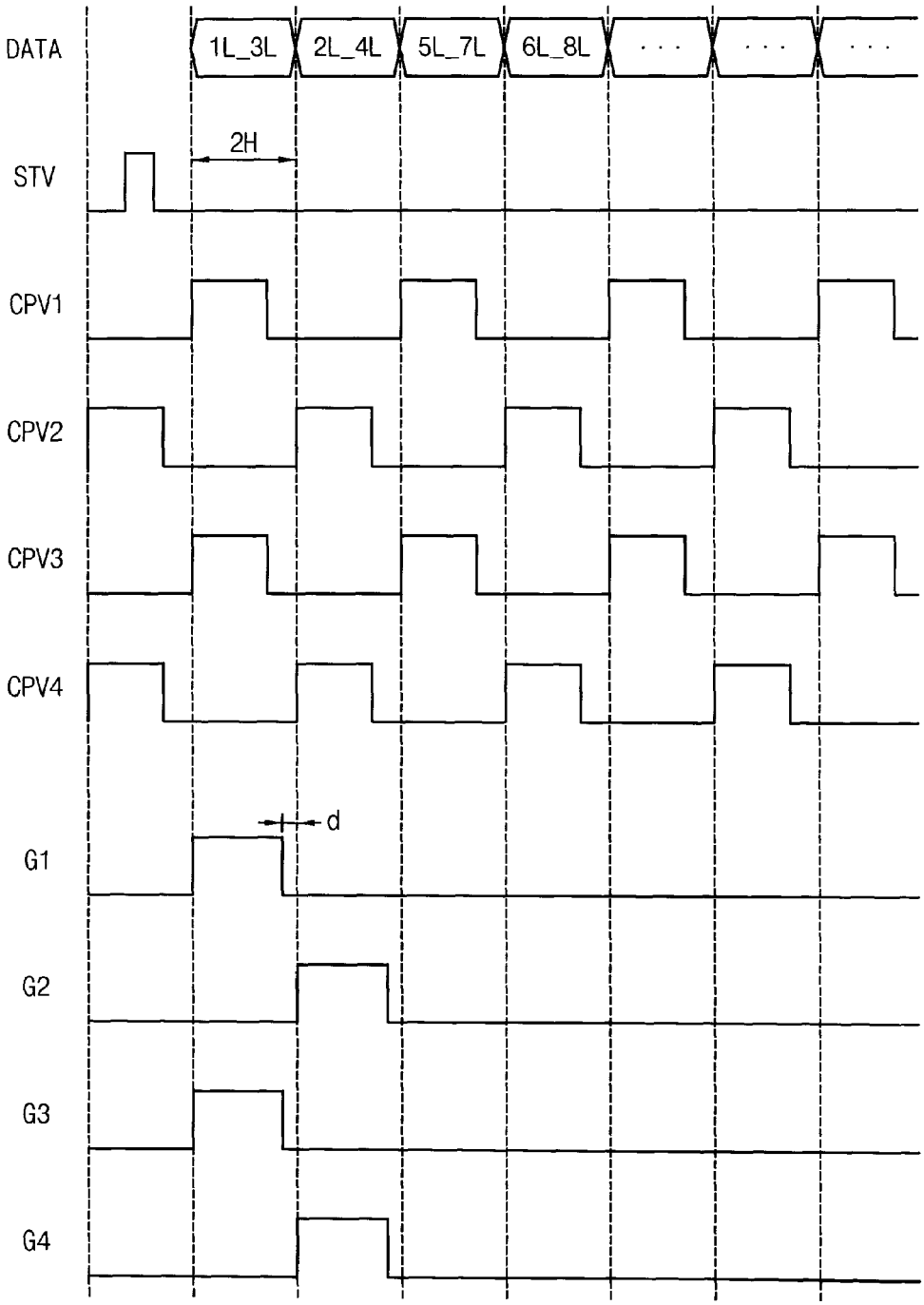
FIG. 4 is a waveform diagram illustrating input and output signals of the gate driving part as shown in FIG. 3.

FIG. 3 is a block diagram illustrating a gate driving part as shown in FIG. 1. FIG. 4 is a waveform diagram illustrating input and output signals of the gate driving part as shown in FIG. 3.

Referring to FIGS. 1, 3 and 4, the gate driving part 250 may include a plurality of shift registers SR1, . . . , SRn and the shift registers SR1, . . . , SRn provide first to n-th gate lines GL1, . . . , GLn with first to n-th gate signals G1, . . . , Gn, respectively.

The gate driving part 250 receives the vertical start signal STV, the first clock signal CPV1, the second clock signal CPV2, third clock signal CPV3, fourth clock signal CPV4, gate-on signal VON and gate-off signal VOFF from the control circuit part 210. The gate driving part may be activated by the vertical start signal STV.

The gate driving part 250 generates the first to n-th gate signals G1, . . . , Gn using the first clock signal CPV1, the second clock signal CPV2, third clock signal CPV3, fourth clock signal CPV4, the gate-on signal VON and gate-off signal VOFF in response to the vertical start signal STV.

The first clock signal CPV1 is a main clock signal of the (4N−3)-th shift register SR1, SR5, . . . and controls a rising period of a high pulse in the (4N−3)-th gate signal G1, G5, . . . . The second clock signal CPV2 is a main clock signal of the (4N−2)-th shift register SR2, SR6, . . . and controls a rising period of a high pulse in the (4N−2)-th gate signal G2, G6, . . . . The third clock signal CPV3 is a main clock signal of the (4N−1)-th shift register SR3, SR7, . . . and controls a rising period of a high pulse in the (4N−1)-th gate signal G3, G7, . . . . The fourth clock signal CPV4 is a main clock signal of the 4N-th shift register SR4, SR8, . . . and controls a rising period of a high pulse in the 4N-th gate signal G4, G8, . . . . As shown in FIG. 4, the first and third clock signals CPV1 and CPV3 are the same signal. The second and fourth clock signals CPV2 and CPV4 are the same signal and are different (in phase) from the first and third clock signals CPV1 and CPV3. As shown in FIG. 4, the first and third clock signals CPV1 and CPV3 are delayed by 2 horizontal periods (2H) from the second and fourth clock signals CPV2 and CPV4.

According to the exemplary embodiment, the vertical start signal STV is applied to first, second, third and fourth shift registersSR1, SR2, SR3 and SR4, respectively. The first, second, third and fourth shift registers SR1, SR2, SR3 and SR4 generate the first, second, third and fourth gate signals G1, G2, G3 and G4 in synchronization with rising periods of the first, second, third and fourth clock signals CPV1, CPV2, CPV3 and CPV4.

The first and third shift registers SR1 and SR3 output the first and third gate signals G1 and G3 which include respectively high pulses (of durations almost equal to 2H) as controlled by the rising periods by the first and third clock signals CPV1 and CPV3 of the same signal. The high pulse of the first and third gate signals G1 and G3 may have a width corresponding to just shy of 2H (by timing distance d). The first and third gate signals G1 and G3 are applied to the first and third gate lines, respectively.

In synchronization with the first and third gate signals G1 and G3, the data driving part 230 outputs a data signal 1L_3L of the first and third pixel rows to the data lines. Therefore, the data signal 1L_3 L of the first and third pixel rows is charged into the first and third pixel rows in response to the high pulse states of the first and third gate signals G1 and G3.

Then, the second and fourth shift registers SR2 and SR4 output the second and fourth gate signals G2 and G4 which include respectively high pulse states as controlled by the rising periods by the second and fourth clock signals CPV2 and CPV4 of the same signal. The high pulse of the second and fourth gate signals G2 and G4 may have a width corresponding to just shy of 2H. The second and fourth gate signals G2 and G4 are applied to the second and fourth gate lines, respectively.

In synchronization with the second and fourth gate signals G2 and G4gate signals G2 and G4, the data driving part 230 outputs a data signal 2L_4L of the second and fourth pixel rows to the data lines. Therefore, the data signal 2L_4L of the second and fourth pixel rows is charged into the second and fourth pixel rows in response to the high pulse of the second and fourth gate signals G2 and G4.

If a falling period of the third gate signal is allowed to overlap with a rising period of the second gate signal, a kickback dropping of a voltage may be generate at the rising period of the a the second gate signal by the falling period the third gate signal. The falling period of a gate signal being a period during which a level of the gate signal falls from a high level to a low level and the rising period of the gate signal being a period during which a level of the gate signal rises from a low level to a high level.

Therefore, in the exemplary embodiments, a falling period of the high pulse in the first and third gate signals G1 and G3 is spaced apart from a rising period of the high pulse in the second the fourth gate signals G2 and G4 by a predetermined timing distance 'd' to prevent the undesirable generation of the kickback effect. The falling period of the high pulse in the gate signal may be controlled by an output enable signal received from the control circuit part 210. When the predetermined period d is at least about 1 μs to 2 μs, the kickback may be prevented.

Then, the fifth and seventh shift registers SR5 and SR7 output fifth and seventh gate signals G5 and G7 controlled a rising period by the first and third clock signals CPV1 and CPV3. The fifth shift register SR5 receives a carry signal from the first shift register SR1. Similarly, the seventh shift register SR7 receives the carry signal of the third shift register SR3.

The rising period of the high pulse in the fifth and seventh gate signals G5 and G7 is spaced apart from the falling period of the high pulse in the second and fourth gate signals G2 and G4 by a predetermine period 'd'.

In synchronization with the fifth and seventh gate signals G5 and G7, the data driving part 230 outputs a data signal 5L_7L of fifth and seventh pixel rows to the data lines. Therefore, the data signal 5L_7L of the fifth and seventh pixel rows is charged into the fifth and seventh pixel rows in response to the high pulse of the fifth and seventh gate signals G5 and G7.

As described above, the data driving part 230 and the gate driving part 250 are driven, so that the display panel 100 alternately refreshes (recharges) the image on two odd-numbered pixel rows and then on two even-numbered pixel rows. In the exemplary embodiments, each of the simultaneously driven two pixel rows may have their pixels recharged concurrently over a charge period of almost 2H. Therefore, in an ultra high-definition (UD) panel which has a resolution of 4 times higher than that of a conventional high definition (HD) panel, an increased and sufficient charging time for each pixel may be obtained even though the gate lines and the data columns respectively have increased numbers of pixels provided along their respective lengths.

Figure 5:
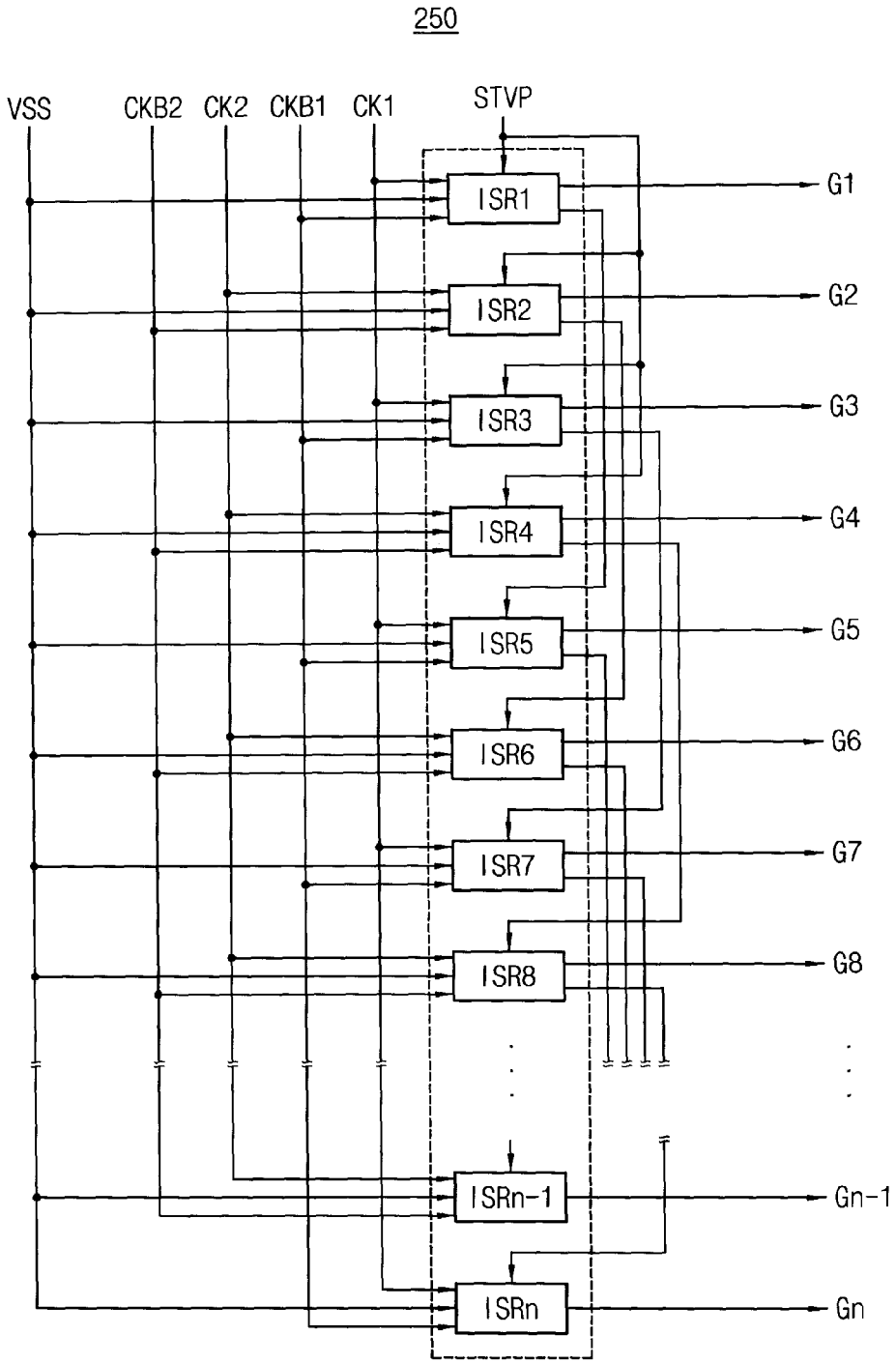
FIG. 5 is a block diagram illustrating a gate driving part according to an exemplary embodiment.
Figure 6:
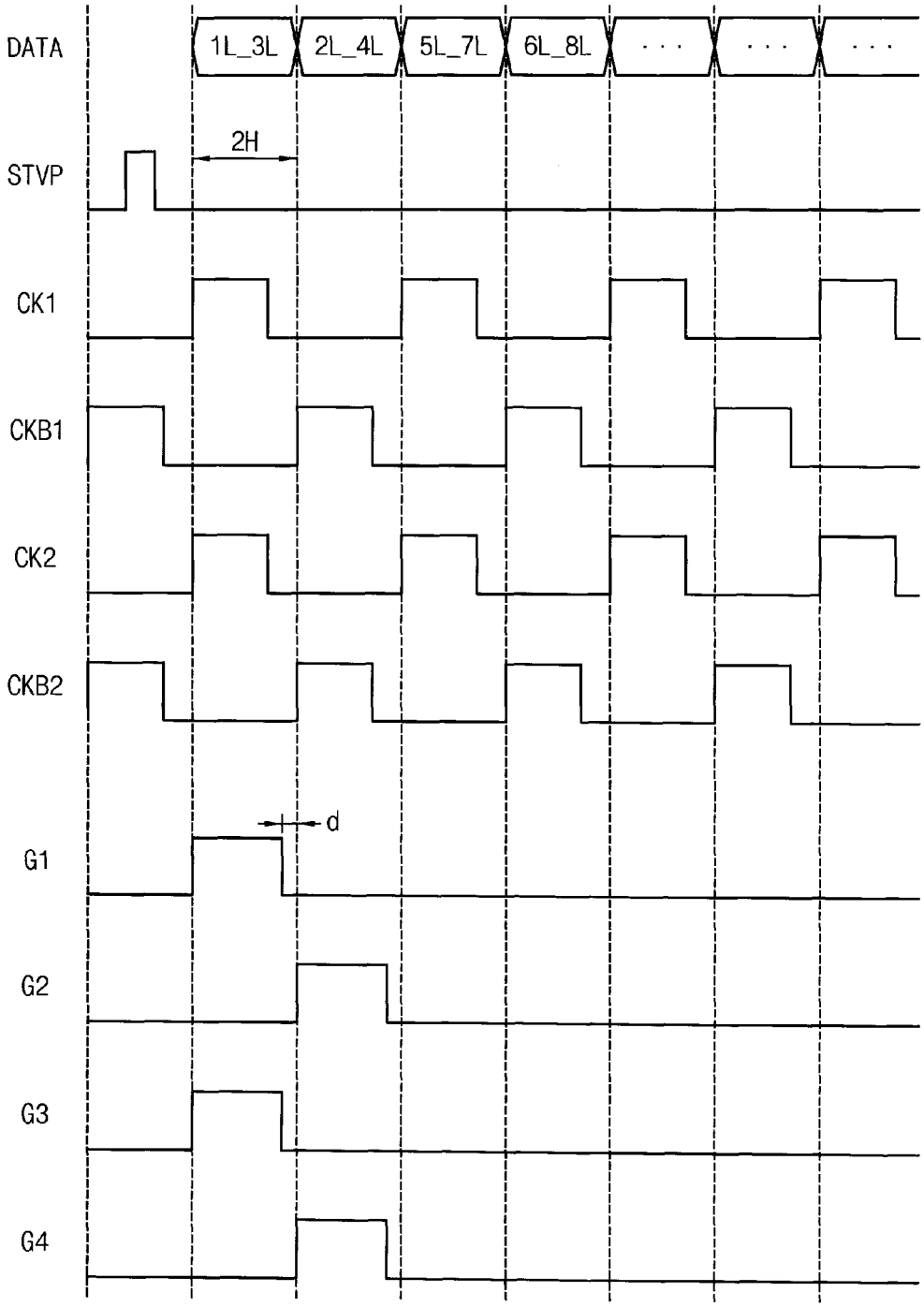
FIG. 6 is a waveform diagram illustrating input and output signals of the gate driving part as shown in FIG. 5.

FIG. 5 is a block diagram illustrating a gate driving part according to another exemplary embodiment. FIG. 6 is a waveform diagram illustrating input and output signals of the gate driving part as shown in FIG. 5.

Referring to FIGS. 1, 5 and 6, the gate driving part 250 may include a plurality of shift registers ISR1, . . . , ISRn, and the shift registers ISR1, . . . , ISRn provide first to n-th gate signals G1, . . . , Gn with first to n-th gate lines G L1, . . . , GLn, respectively.

In the exemplary embodiments, the shift registers ISR1, . . . , ISRn may include a plurality of switching element, the switching elements be formed on the first area A1 of the display panel 100 via the process substantially same as that forming a pixel switching element included in the pixel. In the second area A2 of the display panel 100, a pull-down part may be disposed and the pull-down part pulls a level of a present gate signal from a high level to a low level of the source-off voltage VSS in response to the high level of a next gate signal. The present gate signal is applied to a present gate line and the next gate signal is applied to a next gate line which is located after the present gate line.

The gate driving part 250 receives the vertical start signal STVP, a first clock signal CK1, a corresponding first inversion (or more accurately 180 degree out of phase) clock signal CKB1, a second clock signal CK2, a corresponding second inversion (or more accurately 180 degree out of phase) clock signal CKB2 and a source-off voltage VSS from the control circuit part 210. The first and second clock signals CK1 and CK2 are the same signal and thus, the first. Also the second inversion clock signals CKB1 and CKB2 are the same signal. The gate driving part may be activated by the vertical start signal STVP.

The gate driving part 250 generates the first to n-th gate signals G1, . . . , Gn using the first clock signal CK1, first inversion clock signal CKB1, second clock signal CK2, second inversion clock signal CKB2 and source-off voltage VSS in response to the vertical start signal STVP.

The first clock signal CK1 is a main clock signal of the (4N−3)-th shift register SR1, SR5, . . . and controls a rising period of a high pulse in the (4N−3)-th gate signal G1, G5, . . . . The first inversion clock signal CKB1 controls the low level of the (4N−3)-th gate signal G1, G5, . . . during a remaining period of the frame period except for a period corresponding to the high pulse of the (4N−3)-th gate signal G1, G5, . . . . Thus, the low level of the (4N−3)-th gate signal G1, G5, . . . may be maintained as that of the source-off voltage VSS.

The first inversion clock signal CKB1 is a main clock signal of the (4N−2)-th shift register ISR2, ISR6, . . . and controls a rising period of a high pulse in the (4N−2)-th gate signal G2, G6; . . . . The first clock signal CK1 controls the low level of the (4N−2)-th gate signal G2, G6, . . . during a remaining period of the frame period except for a period corresponding to the high pulse of the (4N−2)-th gate signal G2, G6, . . . . Thus, the low level of the (4N−2)-th gate signal G2, G6, . . . may be maintained as that of the source-off voltage VSS.

The second clock signal CK2 is a main clock signal of the (4N−1)-th shift register ISR3, ISR7, . . . and controls a rising period of a high pulse in the (4N−1)-th gate signal G3, G7, . . . . The second inversion clock signal CKB2 controls the low level of the (4N−1)-th gate signal G3, G7, . . . during a remaining period of the frame period except for a period corresponding to the high pulse of the (4N−1)-th gate signal G3, G7, . . . . Thus, the low level of the (4N−1)-th gate signal G3, G7, . . . may be maintained as that of the source-off voltage VSS.

The second inversion clock signal CKB2 is a main clock signal of the 4N-th shift register ISR4, ISR8, . . . and controls a rising period of a high pulse in the 4N-th gate signal G4, G8, . . . . The second clock signal CK2 controls the low level of the 4N-th gate signal G4, G8, . . . during a remaining period of the frame period except for a period corresponding to the high pulse of the 4N-th gate signal G4, G8, . . . . Thus, the low level of the 4N-th gate signal G4, G8, . . . may be maintained as that of the source-off voltage VSS.

According to the exemplary embodiment, the vertical start signal STVP is applied to first, second, third and fourth shift registers ISR1, ISR2, ISR3 and ISR4, respectively. The first, second, third and fourth shift registers ISR1, ISR2, ISR3 and ISR4 generate the first, second, third and fourth gate signals G1, G2, G3 and G4 in synchronization with rising periods of the clock signals CK1, CKB1, CK2 and CKB2.

The first and third shift registers ISR1 and ISR3 output the first and third gate signals G1 and G3 which include respectively high state pulses controlled by the rising periods of the first and second clock signals CK1 and CK2 of the same signal. The high pulse of the first and third gate signals G1 and G3 may have a width corresponding to just shy of 2H. The first and third gate signals G1 and G3 are applied to the first and third gate lines, respectively.

In synchronization with the first and third gate signals G1 and G3, the data driving part 230 outputs a data signal 1L_3L of the first and third pixel rows to the data lines. Therefore, the data signal 1L_3L of the first and third pixel rows is charged into the first and third pixel rows in response to the high pulse of the first and third gate signals G1 and G3.

Then, the second and fourth shift registers ISR2 and ISR4 output the second and fourth gate signals G2 and G4 which include respectively high pulses controlled by the rising periods of the first and second inversion clock signals CKB1 and CKB2 of the same signal. The high pulse of the second and fourth gate signals G2 and G4 may have a width corresponding to just shy of 2H. The second and fourth gate signals G2 and G4 are applied to the second and fourth gate lines, respectively.

In synchronization with the second and fourth gate signals G2 and G4 gate signals G2 and G4, the data driving part 230 outputs a data signal 2L_4L of the second and fourth pixel rows to the data lines. Therefore, the data signal 2L_4L of the second and fourth pixel rows is charged into the second and fourth pixel rows in response to the high pulse of the second and fourth gate signals G2 and G4.

In the exemplary embodiments, a falling period of the high pulse in the first and third gate signals G1 and G3 is spaced apart from a rising period of the high pulse in the second the fourth gate signals G2 and G4 by a predetermined period 'd' to prevent a kickback effect from being generated.

According to the present exemplary embodiment, two odd-numbered pixel rows and two even-numbered pixel rows are alternately driven so that a charge period of each pixel may be extended to be almost equal to 2H. In addition, a kickback difference between the odd-numbered pixel row and the even-numbered pixel row may be decreased so that a display quality may be improved. In addition, the display panel may be driven with the column inversion mode so that power consumption may be reduced and degradation due to constant driving with a same polarity may be reduced.

The foregoing is illustrative of the present disclosure of invention and is not to be construed as limiting thereof Although a few exemplary embodiments of the present teachings have been described, those skilled in the art will readily appreciate from the foregoing that many modifications are possible in the exemplary embodiments without materially departing from the novel teachings and advantages of the present disclosure.

Accordingly, all such modifications are intended to be included within the scope of the present teachings. In the claims, means-plus-function clauses are intended to cover the structures described herein as performing the recited function and not only structural equivalents but also functionally equivalent structures.

What is claimed is:

1. A display panel comprising:

a plurality of pixels which is arranged in a pixel column and a pixel row;

a gate line which is connected to pixels in a same pixel row;

a first data line which is connected to pixels in a same pixel column; and a second data line which is connected to remaining pixels except for the pixels connected to the first data line among the pixels in the same pixel column, wherein the pixels in the same pixel column are alternately connected to the first and second data lines every two pixels.

2. The display panel of claim 1, further comprising:

a third data line which is connected to pixels of a second pixel column adjacent to a first pixel column; and a fourth data line which is connected to remaining pixels except for the pixels connected to the third data line among the pixels in the second pixel column, wherein the first and second data lines are connected to the pixels of the first pixel column.

3. The display panel of claim 2, wherein (4N−3)-th and (4N−2)-th pixels in the first pixel column are connected to the first data line, (4N−1)-th and 4N-th pixels in the first pixel column are connected to the second data line adjacent to the first data line, (4N−1)-th and 4N-th pixels in the second pixel column are connected to the third data line adjacent to the second data line, and (4N−3)-th and (4N−2)-th pixels in the second pixel column are connected to the fourth data line adjacent to the third data line.

4. A display apparatus comprising:

a display panel which comprises a plurality of pixels which is arranged in a pixel column and a pixel row, a gate line which is connected to pixels in a same pixel row, a first data line and a second data line which are connected to pixels in a same pixel column;

a gate driving part which concurrently outputs two gate signals; and a data driving part which concurrently outputs data signals corresponding to two pixel rows, wherein the pixels in the same pixel column are alternately connected to the first and second data lines every two pixels.

5. The display apparatus of claim 4, wherein the gate driving part alternately outputs two odd-numbered gate signals and two even-numbered gate signals.

6. The display apparatus of claim 5, wherein a falling period of an odd-numbered gate signal is spaced apart from a rising period of an even-numbered gate signal, wherein the falling period of a gate signal being a period during which a level of the gate signal falls from a high level to a low level and the rising period of the gate signal being a period during which a level of the gate signal rises from a low level to a high level.

7. The display apparatus of claim 5, wherein the odd-numbered and even-numbered gate signal respectively have a high pulse corresponding to two horizontal periods.

8. The display apparatus of claim 4, wherein the data driving part outputs a data signal of a first polarity with respect to a reference signal to the first data line and a data signal of a second polarity with respect to the reference signal to the second data line.

9. The display apparatus of claim 8, wherein the display panel further comprising:

a third data line which is connected to pixels of a second pixel column adjacent to a first pixel column; and a fourth data line which is connected to remaining pixels except for the pixels connected to the third data line among the pixels in the second pixel column, wherein the first and second data lines are connected to the pixels of the first pixel column.

10. The display apparatus of claim 9, wherein (4N−3)-th and (4N−2)-th pixels of the first pixel column are connected to the first data line, (4N−1)-th and 4N-th pixels of the first pixel column are connected to the second data line adjacent to the first data line, (4N−1)-th and 4N-th pixels of the second pixel column are connected to the third data line adjacent to the second data line, and (4N−3)-th and (4N−2)-th pixels of the second pixel column are connected to the fourth data line adjacent to the third data line.

11. The display apparatus of claim 10, wherein the data driving part outputs a data signal of the first polarity to the third data line and a data signal of the second polarity to the fourth data line.

12. The display apparatus of claim 4, wherein the gate driving part comprises a plurality of shift registers, first, second, third and fourth shift registers of the plurality of shift registers receiving a vertical start signal, the gate driving part being activated by the vertical start signal.

13. The display apparatus of claim 12, wherein the gate driving part is formed as a chip and mounted on the display panel.

14. The display apparatus of claim 13, wherein the gate driving part controls a rising period of a high pulse in a (4N−3)-th gate signal base on a first clock signal, a rising period of a high pulse in a (4N−2)-th gate signal base on a second clock signal, a rising period of a high pulse in a (4N−1)-th gate signal base on a third clock signal and a rising period of a high pulse in a 4N-th gate signal base on a fourth clock signal.

15. The display apparatus of claim 14, wherein the first clock signal is the same as the third clock signal and the second clock is the same as the fourth clock signal.

16. The display apparatus of claim 12, wherein the gate driving part includes a plurality of switching elements be formed on the display panel via a fabrication process substantially the same as that used for forming a pixel switching element included in the pixel.

17. The display apparatus of claim 16, the gate driving part controls a rising period of a high pulse in a (4N−3)-th gate signal base on a first clock signal, a rising period of a high pulse in a (4N−2)-th gate signal base on a first inversion clock signal opposite to the first clock signal, a rising period of a high pulse in a (4N−1)-th gate signal base on a second clock signal and a rising period of a high pulse in a 4N-th gate signal base on a second inversion clock signal opposite to the second clock signal.

18. The display apparatus of claim 17, wherein the first clock signal is the same as the second clock signal.

19. A display panel comprising:

a plurality of pixels which is arranged in a pixel column and a pixel row;

a gate line which is connected to pixels in a same pixel row;

a first data line which is connected to pixels in a same pixel column;

a second data line which is connected to remaining pixels except for the pixels connected to the first data line among the pixels in the same pixel column;

a third data line which is connected to pixels of a second pixel column adjacent to a first pixel column; and a fourth data line which is connected to remaining pixels except for the pixels connected to the third data line among the pixels in the second pixel column, wherein the first and second data lines are connected to the pixels of the first pixel column, wherein the pixels in the same pixel column are alternately connected to the first and second data lines every two pixels, and wherein (4N−3)-th and (4N−2)-th pixels in the first pixel column are connected to the first data line, (4N−1)-th and 4N-th pixels in the first pixel column are connected to the second data line adjacent to the first data line, (4N−1)-th and 4N-th pixels in the second pixel column are connected to the third data line adjacent to the second data line, and (4N−3)-th and (4N−2)-th pixels in the second pixel column are connected to the fourth data line adjacent to the third data line.

* * * * *